US006637767B2

(12) United States Patent
Chevalier et al.

(10) Patent No.: US 6,637,767 B2
(45) Date of Patent: Oct. 28, 2003

(54) SUPPORT DEVICE FOR THE FRONT OF A SKI BOOT

(75) Inventors: Jean-Louis Chevalier, Varenne-Vauzelles (FR); Frédéric Quillard, Nevers (FR); Thierry Brugeas, Grenoble (FR)

(73) Assignee: Look Fixations, SA, Nevers (FR)

( * ) Notice: Subject to any disclaimer, the term of this patent is extended or adjusted under 35 U.S.C. 154(b) by 0 days.

(21) Appl. No.: 09/755,335

(22) Filed: Jan. 5, 2001

(65) Prior Publication Data

US 2001/0011808 A1 Aug. 9, 2001

(30) Foreign Application Priority Data

Jan. 7, 2000 (FR) ..... 00 00226

(51) Int. Cl.[7] ..... A63C 5/00; A63C 9/00
(52) U.S. Cl. ..... 280/607; 280/618; 280/636
(58) Field of Search ..... 280/607, 617, 280/618, 636

(56) References Cited

U.S. PATENT DOCUMENTS

| | | | | | |
|---|---|---|---|---|---|
| 3,685,846 | A | * | 8/1972 | Schmid | 280/607 |
| 3,814,454 | A | | 6/1974 | Beyl | 280/11.35 C |
| 3,854,738 | A | * | 12/1974 | Fish | 280/607 |
| 3,905,906 | A | * | 9/1975 | Edmund | 280/636 |
| 4,336,956 | A | * | 6/1982 | Richert et al. | 280/625 |
| 4,398,747 | A | | 8/1983 | Bernard et al. | 280/630 |
| 4,516,792 | A | | 5/1985 | Scheck et al. | 280/625 |
| 4,568,100 | A | * | 2/1986 | Eriksson | 280/602 |
| 4,592,568 | A | * | 6/1986 | Priskich | 280/607 |
| 4,678,200 | A | * | 7/1987 | Powell | 280/607 |
| 4,735,435 | A | * | 4/1988 | Hornschemeyer et al. | 280/625 |
| 4,889,359 | A | * | 12/1989 | Kowatsch et al. | 280/629 |
| 4,902,031 | A | | 2/1990 | Bogner | 280/625 |
| 4,911,463 | A | * | 3/1990 | Gertsch | 280/629 |
| 4,928,988 | A | * | 5/1990 | Hue | 280/607 |
| 4,928,990 | A | * | 5/1990 | Rullier | 280/625 |
| 5,114,174 | A | | 5/1992 | Bogner | 280/636 |
| 5,303,950 | A | * | 4/1994 | Rigal et al. | 280/636 |
| 5,332,252 | A | * | 7/1994 | Le Masson et al. | 280/602 |
| 5,338,051 | A | * | 8/1994 | Szafranski et al. | 280/607 |
| 5,344,180 | A | * | 9/1994 | Lancon et al. | 280/625 |
| 5,413,371 | A | * | 5/1995 | Trimble | 280/602 |
| 5,474,321 | A | * | 12/1995 | Pritz | 280/607 |
| 5,499,836 | A | * | 3/1996 | Juhasz | 280/602 |
| 5,636,856 | A | * | 6/1997 | Luitz et al. | 280/607 |
| 5,681,054 | A | * | 10/1997 | Bonvallet | 280/602 |
| 5,687,982 | A | * | 11/1997 | Challande et al. | 280/607 |
| 5,722,681 | A | * | 3/1998 | Merino et al. | 280/634 |
| 5,730,457 | A | | 3/1998 | Coudere et al. | 280/602 |
| 5,890,731 | A | * | 4/1999 | Challande et al. | 280/625 |
| 5,921,573 | A | | 7/1999 | Challande et al. | 280/636 |

FOREIGN PATENT DOCUMENTS

| | | |
|---|---|---|
| FR | 2165747 | 8/1973 |
| FR | 2615748 | 12/1988 |
| FR | 2687326 | 8/1993 |
| FR | 2755868 | 5/1998 |

* cited by examiner

*Primary Examiner*—Brian L. Johnson
*Assistant Examiner*—Bridget Avery
(74) *Attorney, Agent, or Firm*—Fay, Sharpe, Fagan, Minnich & McKee, LLP

(57) ABSTRACT

A binding (8) has a lower surface (15) has a width (L5) and is mounted on an upper surface of a ski (2) of width (L2). The width of the lower surface (15) is less than or equal to the width of the ski (2). A support body (9) diverges in width along lateral boarders (19, 20) from the lower surface (15) to an upper surface (18) of width (L4). The upper surface supports an anti-friction plate (10) that defines a support zone (17) of width (L3). The width (L3) of the support zone (17) is greater than width (L5) of the lower surface (15) and the width (L2) if the ski (2).

11 Claims, 5 Drawing Sheets

SUPPORT DEVICE FOR THE FRONT OF A SKI BOOT

BACKGROUND OF THE INVENTION

The present invention relates to improved safety for sporting goods. It finds particular application in conjunction with a frontal binding for supporting and securing the front of a ski boot on a ski and will be described with particular reference thereto. It is to be appreciated that the present invention is also applicable other applications and is not limited to the aforementioned application.

In general, the boot of a skier is retained on the ski in a detachable fashion by its front end, by a frontal binding commonly called a "thrust restraint", and by its rear end, specifically its heel, by a rear binding, commonly called a "heel restraint".

In cases of significant stress, when the leg or joints of the skier are in danger, the ski boot is released from either the front or the rear of the boot or from both locations at once. To that end, the thrust restraint comprises, for example, a jaw which pivots at least laterally around a vertical axis. The heel restraint typically comprises a jaw which pivots in an upward direction around a transverse axis. The jaws of the thrust and heel restraints are each acted upon by an elastic system including a release spring whose compression is regulated in order to provide the skier with an assured stress value for the release of his adjusted boot.

Placement of a support device under the front of the boot in order to limit friction of the sole of the boot with the ski is already known. This type of device is typically fixed to the ski and arranged below the front of the boot between the sole and the upper surface of the ski. Thus, the front of the boot does not rest directly on the ski but on said support device which, for example, includes a stationary element such as a small plate made of a material having a low friction coefficient, such as polytetrafluorethylene, or includes a movable element, which accompanies the end of the boot in the instance of a lateral displacement. Devices of this type are described, for example, in U.S. Pat. No. 3,814,454 and French Patent Application Nos. FR 87 07326 and 96 14339, respectively published under Nos. 2,615,747 and 2,755,868. Such a device, even though providing the skier some improved safety, is not totally satisfactory.

In fact, with current devices, the width of the support zone of the front of the boot is smaller in width than both the sole of the boot and the ski, which results in poor retention of the front of the boot, providing insufficient control of the ski, mainly when "skiing on the edge of the ski," such as when executing a sharp turn.

The present invention provides a new and improved method and apparatus that provides assurance of improved stability and overcomes the above referenced problems and others.

SUMMARY OF THE INVENTION

According to one aspect of the present invention, a device for supporting a ski boot on a ski supports a lower surface of a front end of the boot. The device comprises a support piece disposed in a support zone having a width which is larger than the width of the lower surface of the support piece.

According to an additional aspect of the present invention, the width of the support zone is beneficially contained between the width of the ski and the width of the front end of the boot, resting on the support device.

According to another aspect of the present invention, the width of the support zone is greater than or equal to the width of the sole.

According to another aspect of the present invention, the support zone comprises a fixed support on the upper surface of the ski and thereon is fixed, by any means, a small anti-friction plate which constitutes the support zone for the boot.

According to an alternate embodiment of the present invention, the support device comprises a support fixed on the upper surface of the ski and on which is transversely mounted a mobile support element which constitutes the support zone for the boot.

According to a more limited aspect of the present invention, the lateral borders of the support in the region where the support zone is located are inclined so as to converge toward the bottom.

One advantage of the present invention resides in improved stability.

Another advantage resides in better control of the ski, particularly when skiing on the edge of the ski.

Still further benefits and advantages of the present invention will become apparent to those skilled in the art upon a reading and understanding of the preferred embodiments.

BRIEF DESCRIPTION OF THE DRAWINGS

The invention may take form in various components and arrangements of components, and in various steps and arrangements of steps. The drawings are only for purposes of illustrating preferred embodiments and are not to be construed as limiting the invention.

DETAILED DESCRIPTION OF THE PREFERRED EMBODIMENT

Figure 1:
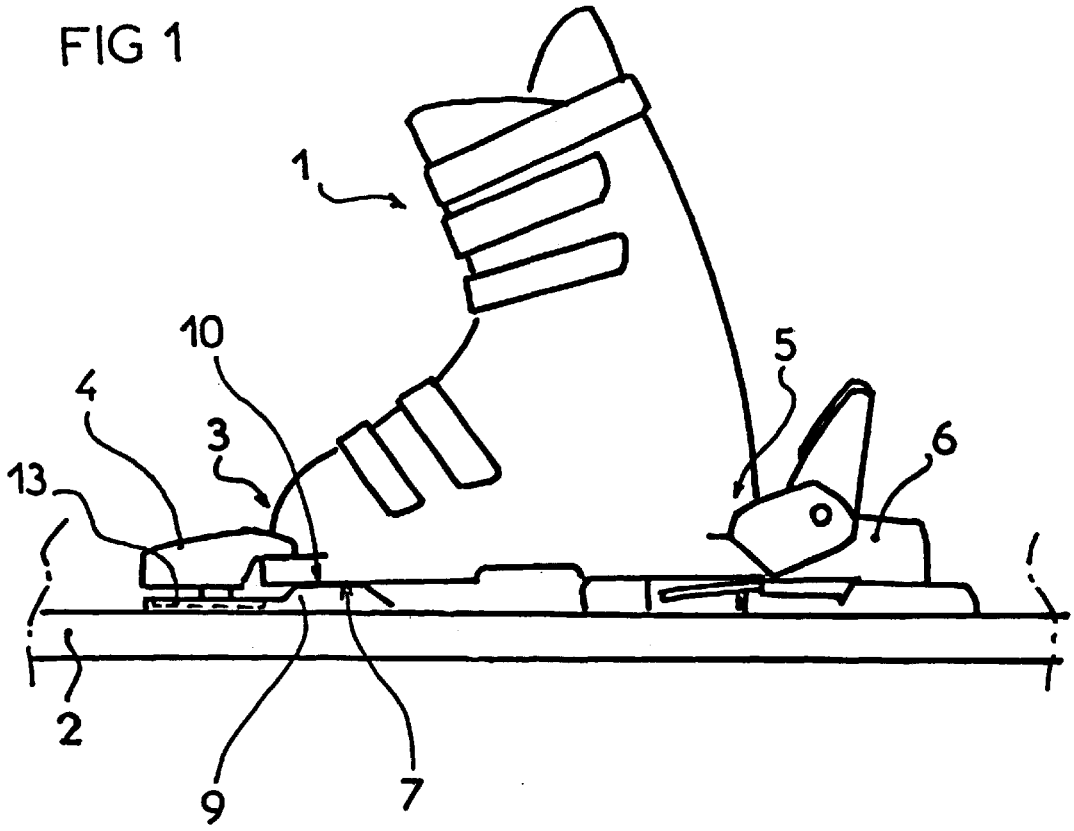
FIG. 1 is a lateral view of a ski with front and rear boot bindings and support zone in accordance with the present invention.
Figure 2:
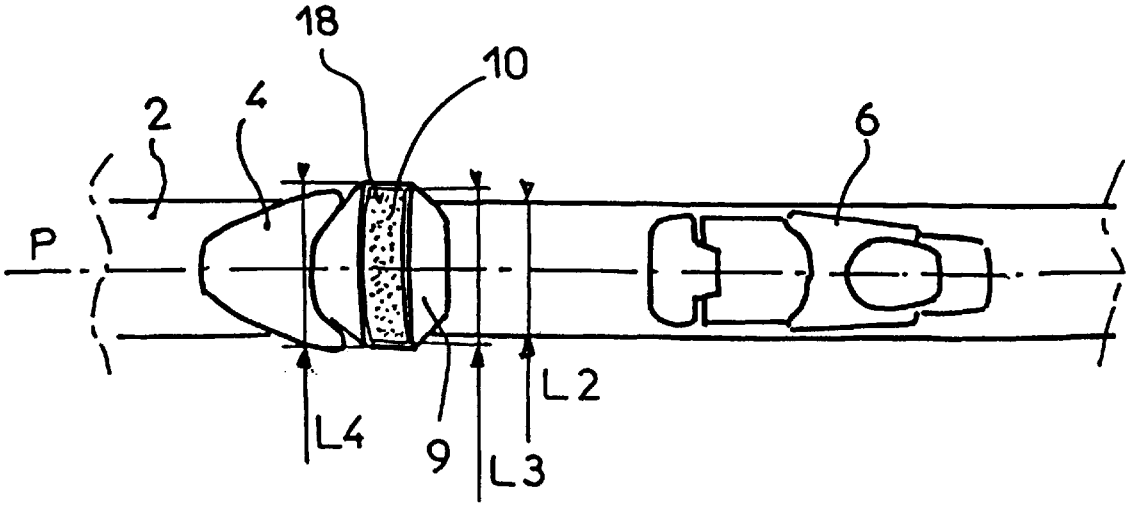
FIG. 2 is a top-down view of FIG. 1 without the boot.

With reference to FIGS. 1 and 2 in the preferred embodiment, a boot 1 of a skier is restrained on a ski 2 in a front-end 3 releasable fashion by a front safety binding 4 commonly called a thrust restraint. The boot 1 is also secured by its rear end, more specifically, by a heel 5 by a rear safety binding 6 called a heel restraint.

In addition, the boot 1 is supported by a sole 7 on a support device 8 of the preferred embodiment.

The support device 8 according to the preferred embodiment on which the front of the sole of the boot 1 supports itself comprises a support 9 disposed on the upper surface of the ski and on which is fastened, by any means, a small anti-friction plate 10.

Figure 3:
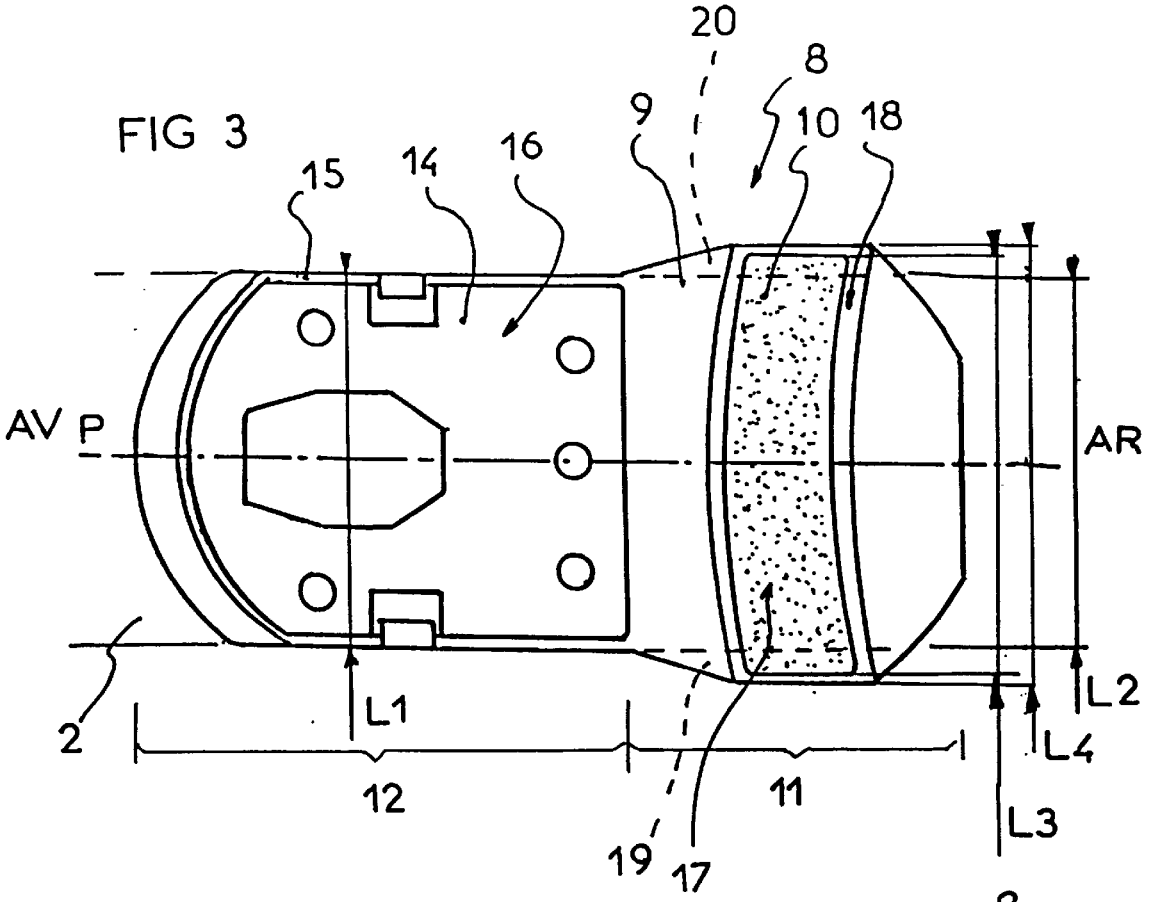
FIG. 3 is a top-down view of a front support device in accordance with the present invention.
Figure 4:
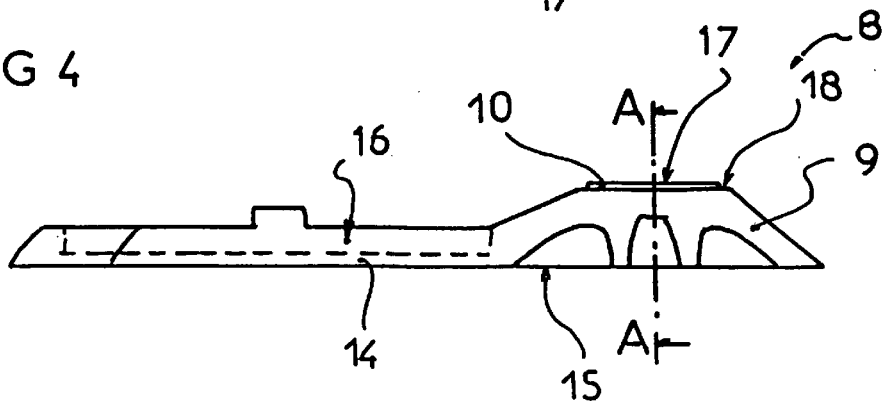
FIG. 4 is a lateral view of the support device of FIG. 3.
Figure 5:
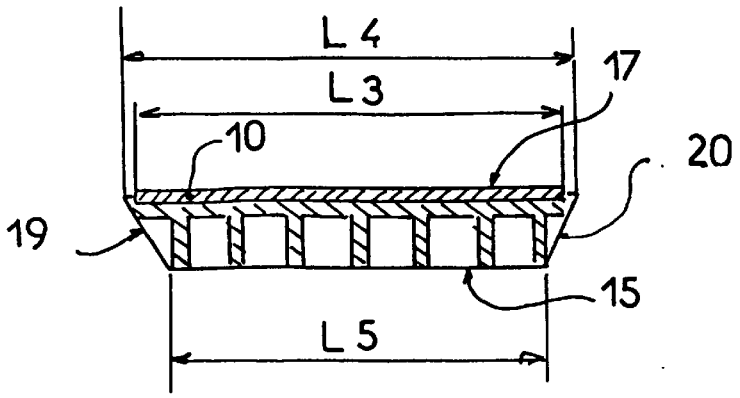
FIG. 5 is a sectional view of the support device through section A—A of FIG. 4.
Figure 6:
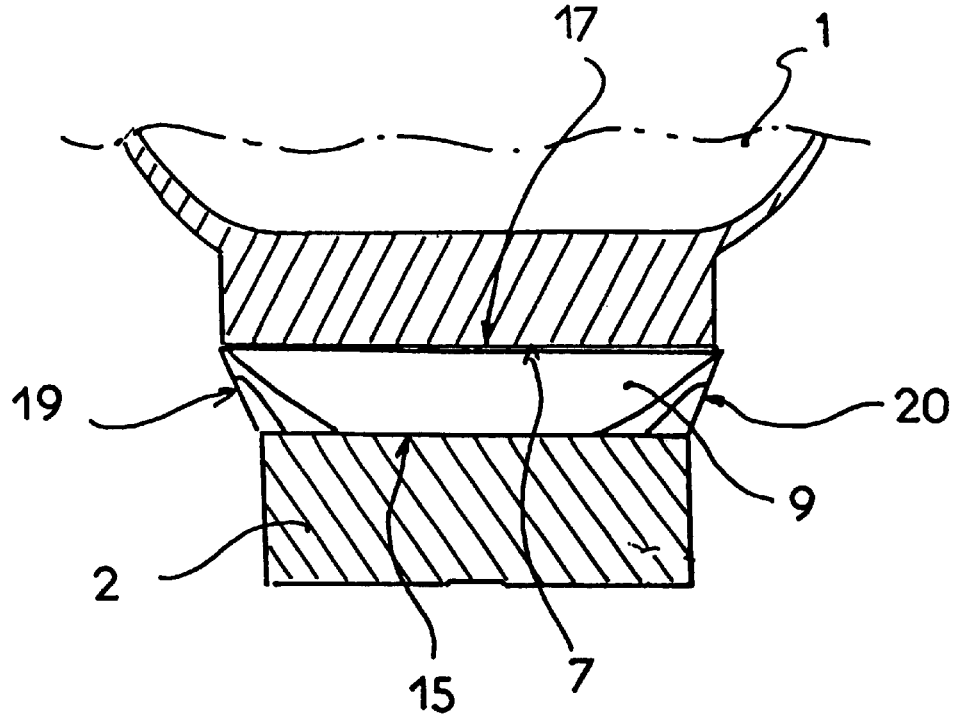
FIG. 6 is an end view of the support device, including the ski and boot.
Figure 7:
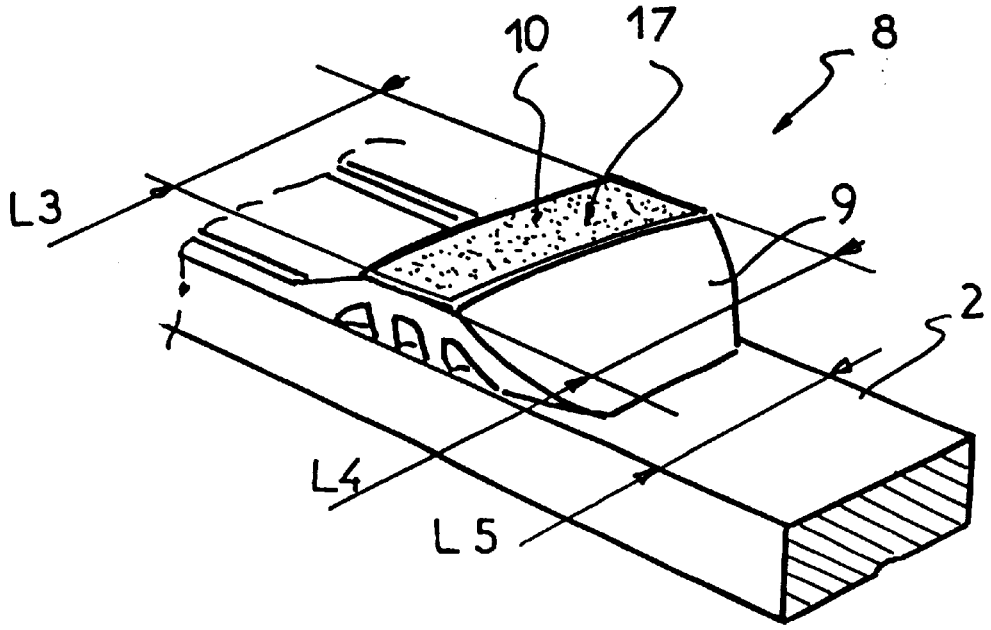
FIG. 7 is a perspective view of the support device and ski.
Figure 8:
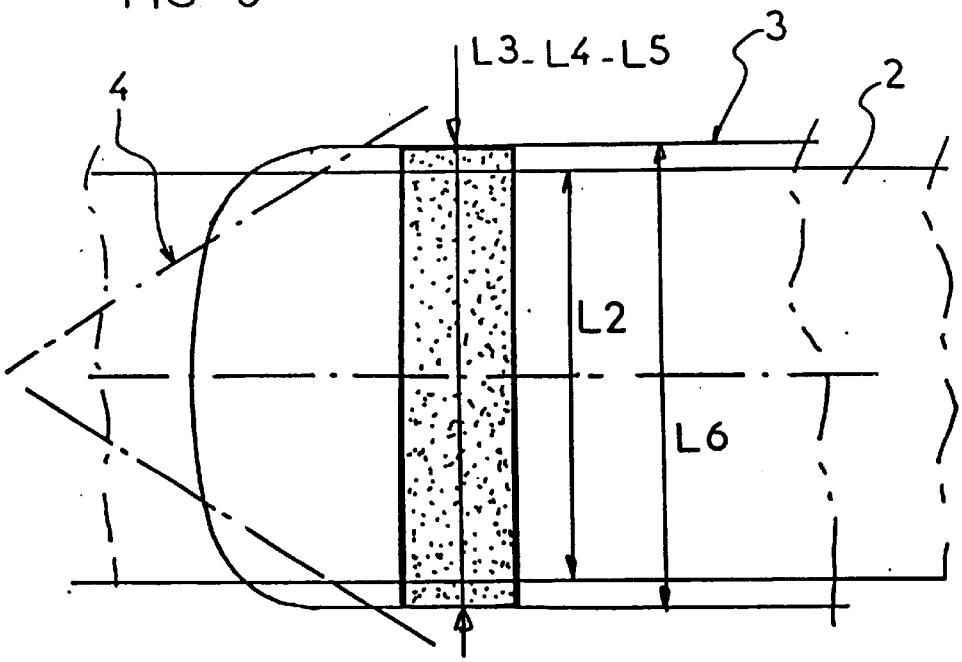
FIG. 8 is a schematic view representing the support zone device according to the present invention.

The support piece 9 of the preferred embodiment comprises at least one rear section 11 which includes the small anti-friction plate 10 and includes, as illustrated in FIGS. 3 and 4, a front portion 12 engaged below a base 13 of the front binding 4. The support piece 9 is constructed of plastic material, such as an acetal type resin, a polyamide, or the like, and fixed on the ski by being joined with the front binding 4 in the preferred embodiment.

The anti-friction plate 10 in the preferred embodiment is an elongated plate made of low friction coefficient material or at least with a lower friction coefficient than the one of the material with which the support 9 is made. For example, the small anti-friction plate 10 can be polytetrafluorethylene (PTFE), high density polyethylene, or a material such as polytetrafluorethylene loaded with bronze balls, or the like.

The front portion 12 of the support 9 comprises a lower wall 14 bordered laterally by a peripheral wall 15 that forms with the lower wall 14 a bowl 16 for receiving the base 13 of the front binding 4.

The front portion 12 extends towards the rear by the rear portion 11. The rear portion 11 receives the anti-friction plate 10.

According to the preferred embodiment, a width L1 of the front portion 12 of the support 9 is less than or equal to a width L2 of the ski 2; whereas, the width of the rear portion 11 of the support 9 is such that a support zone 17 of the front of the boot sole has a width L3 which is greater than the width L2 of the ski 2 in the corresponding zone, with the measure of the width being taken transversely, perpendicular to an axis P of general symmetry of the ski. Thus, a width L3 of the anti-friction plate which constitutes the support zone 17 is greater than the width L2 of the ski 2.

According to the preferred embodiment as illustrated in FIGS. 1 to 7, the anti-friction plate 10 is partially embedded in the support 9 so as to project slightly in an upward direction. It should be noted that an upper surface 18 of the rear portion 11 of the support 9, that is, the embedding zone of the plate, has a slightly larger width L4 than the width L3 of the anti-friction plate 10. The width L4 of the upper surface 18 where said small plate 10 is located is thus greater than the width L2 of the ski 2.

It should also be noted that the rear portion 11 of the support is such that its lower surface 15 is, at least in the portion within the support zone, smaller than the width L3 of the small anti-friction plate 10 and the width L4 of the upper surface 18. Also, the width L4 of the upper surface 18 as well as the width L3 of the small anti-friction plate 10 is greater than the width L5 of the lower surface 15 of said support. It should be noted that lateral borders 19, 20 of the support in the zone, where the support zone 17 is located, are inclined so that they converge toward the bottom.

Figure 9:
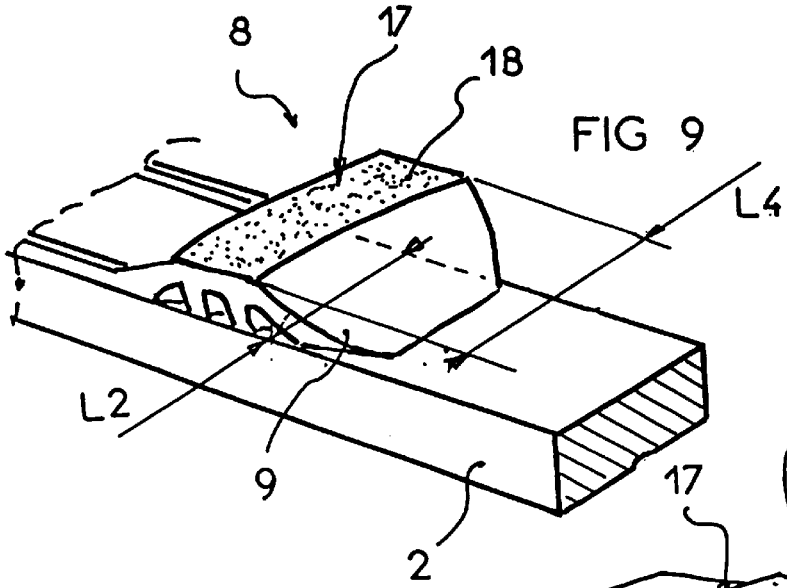
FIG. 9 is a perspective view of an alternate embodiment of the present invention.

It is, of course, understood that the invention also concerns an alternate support device a illustrated in FIG. 9, according to which the support 9 does not include any anti-friction element, the boot 1 being directly supported on the upper surface 18 of the rear portion 11 of the support which has a width L4, the upper surface being now the support zone 17 for the boot.

Figure 10:
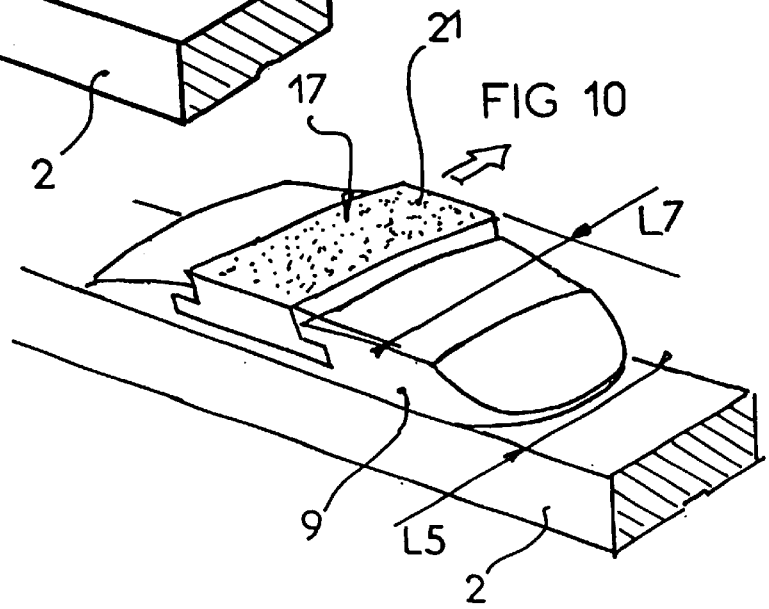
FIG. 10 is a perspective view of an alternate embodiment of the present invention.

It is understood that the invention concerns any other type of support device for the front end of the boot, such as for example a support device of the type described in French Patent No. 96 14339 and comprising a mobile support element. This type of device is illustrated in FIG. 10 and comprises a stationary support 9 on which a movable support element 21 moves laterally. In this alternate embodiment a width L7 of the support zone is greater than the width L2 of the ski.

It is understood that the width L3, L4, L7 of the support zone 17 is as large as possible and greater than the width L5 of the lower surface 15 of the support, at least in the region where the support zone 17 is located. The support zone 17 is beneficially contained between the width L2 of the ski and the width L6 of the sole in the zone of its front end, supporting the support device. Of course, the width L3, L4, L7 of the support zone 17 can be greater than the width L6 of the sole, but the width L3, L4, L7 of the support zone 17 is preferably equal to the width L6 of the sole.

Figure 11:
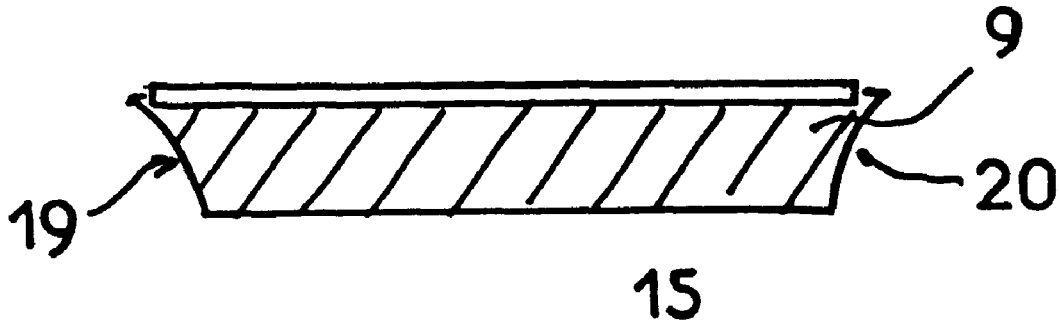
FIG. 11 is a transverse sectional view of an alternate support embodiment.
Figure 12:
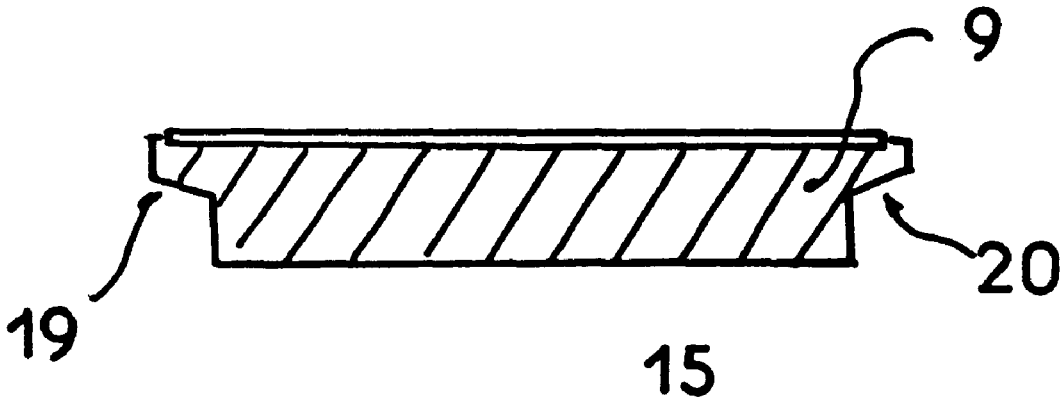
FIG. 12 is a transverse sectional view of another alternate support embodiment.

FIGS. 11 and 12 are representations illustrating other alternate embodiments of lateral edges 19, 20 of the support piece. According to FIG. 11, the lateral edges 19, 20 are concave, whereas according to the variation of FIG. 12, these are realized by a succession of non-coplanar surfaces. Of course, according to these two variations, the width of the upper surface 18 of the support is greater than the width L5 of its lower side 15.

The invention has been described with reference to the preferred embodiment, modifications and alterations will occur to others upon a reading and understanding of the preceding detailed description. It is intended that the invention be construed as including all such modifications and alterations insofar as they come within the scope of the appended claims or the equivalents thereof.

Having thus described the preferred embodiments, the invention is now claimed to be:

1. A support device for supporting a ski boot on a ski, the support device fixed on an upper surface of the ski and including:

a support body having a lower surface at a front end which is supported by the ski and an upper surface; and, a support zone defined by an anti-friction plate mounted on the upper surface of the support body which supports the boot, the support zone having a width larger than a width of the lower surface of said support body and equal to or greater than a width of a sole of the boot supported on the support zone, the support body having a transverse width which, in the region of the support zone, decreases from the support zone to the lower surface.

2. The support device according to claim 1, wherein the support zone has a width larger than a width of the ski.

3. The support device according to claim 1, wherein:

lateral edges of the support device in a region where the support zone is located are inclined so as to converge toward the bottom.

4. A support device for supporting a ski boot on a ski, the support device including:

a lower surface at a front end which is supported by the ski;

a support zone defined by an anti-friction plate which supports a front end of the boot, the support zone having a width larger than a width of the lower surface of said support device, larger than a width of the ski, and greater than or equal to a width of a front end of the sole of the boot which is supported on the support device.

5. The support device according to claim 4, wherein the support device includes:

a support fixed on an upper surface of the ski; and, an anti-friction plate mounted on the support which anti-friction plate defines the support zone for the boot.

6. A support device for supporting a ski boot on a ski, the support device including:

a support body fixed on an upper surface of the ski;

a transversely movable support element mounted on the support body, the movable support element defining a support zone for the boot, the support zone having a transverse width equal to or larger than a transverse width of the lower surface of said support body along its entire axial length.

7. The support device according to claim 6, wherein the width of the support zone is greater than a width of a sole of the boot supported on the support zone.

8. The support device according to claim 6, wherein the body includes:

inclined lateral edges that converge toward the lower surface.

9. A support device which supports a front portion of a sole of a ski boot on a ski, the support device including:

a support body having lateral edges that converge toward a lower surface;

a lower surface of the body configured to be mounted to and supported on the ski;

an anti-friction plate mounted to an upper region of the body and configured to support the front portion of the sole, the anti-friction plate having a dimension in a direction transverse to the ski which is larger than a dimension of a transverse width of at least one of the body lower surface and the ski and equal to or greater than a width of the sole.

10. In combination:

a ski having an upper surface and a transverse width in a front binding receiving region;

a front binding having:

a lower surface supported on and mounted to the ski front binding receiving region, the lower surface having a transverse width that matches the ski front binding receiving region width, a body extending upward from the lower surface and diverging outward from the transverse width, and a support zone at an uppermost surface of the body, the support zone having a transverse width that is greater than the transverse widths of the lower surface and the ski front binding receiving region;

a ski boot having a sole, the sole having a transverse width in a region that is supported on the front binding support zone that is greater than the transverse width of the front binding lower surface and the ski front binding receiving region.

11. In combination:

a ski; and a front binding comprising:

a lower surface which is supported on and mounted to a front binding receiving region of the ski, the lower surface having a transverse width that fits within a perimeter of the ski front binding receiving region;

a body extending upward from the lower surface and diverging outward from the transverse width; and a support zone at an uppermost surface of the body, the support zone having a transverse width that is greater than the transverse widths of the lower surface and the ski front binding receiving region.

* * * * *